US007699050B2

(12) United States Patent
Oishi

(10) Patent No.: US 7,699,050 B2
(45) Date of Patent: Apr. 20, 2010

(54) METHOD OF MANUFACTURING (110) SILICON WAFER

(75) Inventor: Hiroshi Oishi, Fukushima (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 22 days.

(21) Appl. No.: 11/992,473

(22) PCT Filed: Sep. 4, 2006

(86) PCT No.: PCT/JP2006/317424

§ 371 (c)(1),
(2), (4) Date: Mar. 24, 2008

(87) PCT Pub. No.: WO2007/037096

PCT Pub. Date: Apr. 5, 2007

(65) Prior Publication Data

US 2009/0084373 A1 Apr. 2, 2009

(30) Foreign Application Priority Data

Sep. 28, 2005 (JP) ..... 2005-281127

(51) Int. Cl.
*B28D 1/02* (2006.01)

(52) U.S. Cl. ..... 125/20; 125/16.01

(58) Field of Classification Search ..... 125/20, 125/16.01, 16.02
See application file for complete search history.

(56) References Cited

U.S. PATENT DOCUMENTS 5,857,454 A * 1/1999 Shibaoka ..... 125/16.02
5,875,769 A * 3/1999 Toyama et al. ..... 125/16.01
5,937,844 A * 8/1999 Kiuchi et al. ..... 125/16.02
7,361,219 B2 * 4/2008 Yoshizawa ..... 117/49
2004/0083863 A1 * 5/2004 Nakashima ..... 83/13
2006/0174820 A1 * 8/2006 Yoshizawa ..... 117/13

FOREIGN PATENT DOCUMENTS

| | | |
|---|---|---|
| EP | 0 798 092 A2 | 10/1997 |
| JP | A-08-085053 | 4/1996 |
| JP | A-09-017755 | 1/1997 |
| JP | A-09-262825 | 10/1997 |
| JP | A-2002-283340 | 10/2002 |

OTHER PUBLICATIONS

Saito et al.; Advantage of Radical Oxidation for Improving Reliability of Ultra-Thin Gate Oxide; *2000 Symposium on VLSI Technology Digest of Technical Papers*; Honolulu, Hawaii; Jun. 13-15, 2000.

* cited by examiner

*Primary Examiner*—Maurina Rachuba
(74) *Attorney, Agent, or Firm*—Oliff & Berridge, PLC

(57) ABSTRACT

The present invention provides a method for slicing a silicon single crystal ingot having a plane direction (110) by a wire saw to manufacture a (110) silicon wafer, wherein slicing is performed in such a manner that each angle formed between a traveling direction of a wire in the wire saw and a [−112 ] direction and a [1-12] direction in the (110) silicon single crystal ingot or a direction crystallographically equivalent to the directions exceeds 30°. As a result, the method for manufacturing the (110) silicon wafer that can suppress occurrence of breaking at the time of slicing and improve a production yield ratio can be provided.

2 Claims, 4 Drawing Sheets

METHOD OF MANUFACTURING (110) SILICON WAFER

TECHNICAL FIELD

The present invention relates to a method of slicing a silicon single crystal ingot having a plane orientation (110) by a wire saw to manufacture a (110) silicon wafer.

BACKGROUND ART

When manufacturing, e.g., a silicon wafer, a silicon single crystal ingot is sliced by a wire saw (see, e.g., Japanese Patent Application Laid-open No. 8-85053). FIG. 2 is a schematic view showing an example of a conventional wire saw. A wire saw 10 is an apparatus which allows a wire 1 (high-tensile steel wire) to travel at a high speed and presses an ingot 3 to be sliced (cut) while applying a slurry having GC (silicon carbide) abrasive grains dispersed in a liquid to this wire 1.

The wire is unreeled from one (right in this example) wire reel 7 to enter groove rollers 2 via a tension providing mechanism 4 formed of a dancer roller 4*a* including a dead weight 4*b* or a powder clutch 4*c* connected with a constant torque motor 4*d* or both the members. Each groove roller 2 is a roller obtained by press-fitting a polyurethane resin to a periphery of a cast steel cylinder and forming a groove on a surface of this cylinder at a fixed pitch, and the wire is wound around this roller for 300 to 400 turns and then taken up by the other wire reel 7 via the other tension providing mechanism 4. The wire is driven by a groove roller driving motor to reciprocate in a wire traveling direction 5 in a predetermined cycle. On the other hand, an ingot 3 is bonded to a slice beam 6, fixed to the wire saw through the slice beam 6, and pressed against the wire at a previously programmed ingot feed speed to be sliced.

On the other hand, a silicon wafer ((110) silicon wafer) having a crystal plane orientation (110) has preferable characteristics that its $I_D/V_{SD}$ (inner conductance) is improved to substantially triple as compared with that in a regular (100) silicon wafer when manufacturing an MOSFET by using this (110) silicon wafer. However, a practical problem in a conventional technology is that a stable surface oxide film cannot be formed on a crystal plane having a plane orientation (110), and the (110) silicon wafer has not been exploited so far. However, a method for forming a stable surface oxide film irrespective of a crystal plane orientation (radical oxidation method) has been recently developed (see, e.g., Saito et al., "Advantage of Radical Oxidation for Improving Reliability of Ultra-Thin Gate Oxide", 2000 Symposium on VLSI Technology, Honolulu, Hi., Jun. 13th-15th, 2000), and the (110) silicon wafer has suddenly come under the spotlight.

The (110) silicon wafer can be manufactured by using a wire saw to slice a silicon single crystal ingot having a plane orientation (110) that has grown in a crystal orientation [110] as a growth direction. However, its slicing yield ratio is lower than that of a silicon wafer having a plane orientation (100), and development of a method for stably obtaining the (110) silicon wafer has been desired.

It is to be noted that a slicing method that avoids cracks or breaking is disclosed in regard to a slicing method for a semiconductor single crystal ingot (see Japanese Patent Application Laid-open No. 9-262825).

DISCLOSURE OF THE INVENTION

It is an object of the present invention to provide a method for manufacturing a (110) silicon wafer, which can suppress occurrence of breaking at the time of slicing using a wire saw and improve a production yield ratio.

To achieve this object, according to the present invention, there is provided a method of manufacturing a (110) silicon wafer by slicing a silicon single crystal ingot having a plane orientation (110) by a wire saw, wherein slicing is performed in such a manner that each angle formed between a traveling direction of a wire in the wire saw and a [−112] direction and a [1-12] direction in the (110) silicon single crystal ingot or a direction crystallographically equivalent to the directions exceeds 30°.

When slicing the (110) silicon single crystal ingot by the wire saw to manufacture the (110) silicon wafer in this manner, performing slicing in such a manner that each angle formed between the traveling direction of the wire in the wire saw and the [−112] direction and the [1-12] direction in the (110) silicon single crystal ingot or the direction crystallographically equivalent to the directions exceeds 30° enables suppressing occurrence of breaking at the time of slicing, thereby improving a production yield ratio.

It is to be noted that the crystallographically equivalent direction is a direction of, e.g., [1-1-2] or [−11-2].

In this case, it is preferable that slicing is performed in such a manner that the angle becomes 30° to 40° from each of the [−112] direction and the [1-12] direction in the (110) silicon single crystal ingot or the direction crystallographically equivalent to the directions.

Performing slicing in such a manner that the angle becomes 30° to 40° from each of the [−112] direction and the [1-12] direction in the (110) silicon single crystal ingot or the direction crystallographically equivalent to these directions in this manner enables further suppressing occurrence of breaking at the time of slicing, thereby improving the production yield ratio.

When slicing the silicon single crystal ingot having the plane orientation (110) by the wire saw to manufacture the (110) silicon wafer in accordance with the present invention, performing slicing in such a manner that each angle formed between the traveling direction of the wire in the wire saw and the [−112] direction and the [1-12] direction in the (110) silicon single crystal ingot or the direction crystallographically equivalent to the directions exceeds 30° enables suppressing occurrence of breaking at the time of slicing, thereby improving the production yield ratio of the (110) silicon wafer.

BEST MODE(S) FOR CARRYING OUT THE INVENTION

The present invention will now be explained hereinafter in detail.

As explained above, although a (110) silicon wafer has not been conventionally exploited since a stable surface oxide film cannot be formed, it has suddenly come under the spotlight due to recent development of a method for forming a stable surface oxide film without being depending on crystal plane orientations.

However, since the conventional technology has a practical problem concerning the oxide film, the (110) silicon wafer has been rarely processed.

Thus, the present inventor has fabricated the (110) silicon wafer by slicing using the wire saw and confirmed that the wafer is extremely apt to be broken at the time of slicing as compared with the conventional (100) silicon wafer.

Specifically, at the time of slicing using the wire saw, when a slice beam is bonded at the same position of crystal orientation as that in the conventional (100) silicon wafer and slicing is performed to obtain each (110) silicon wafer, several—ten % of the wafers may crack in some cases.

As explained above, although a semiconductor single crystal ingot slicing method that avoids cracks or breaking has been conventionally disclosed, the rarely exploited (110) silicon wafer has been hardly specifically examined.

Figure 3:
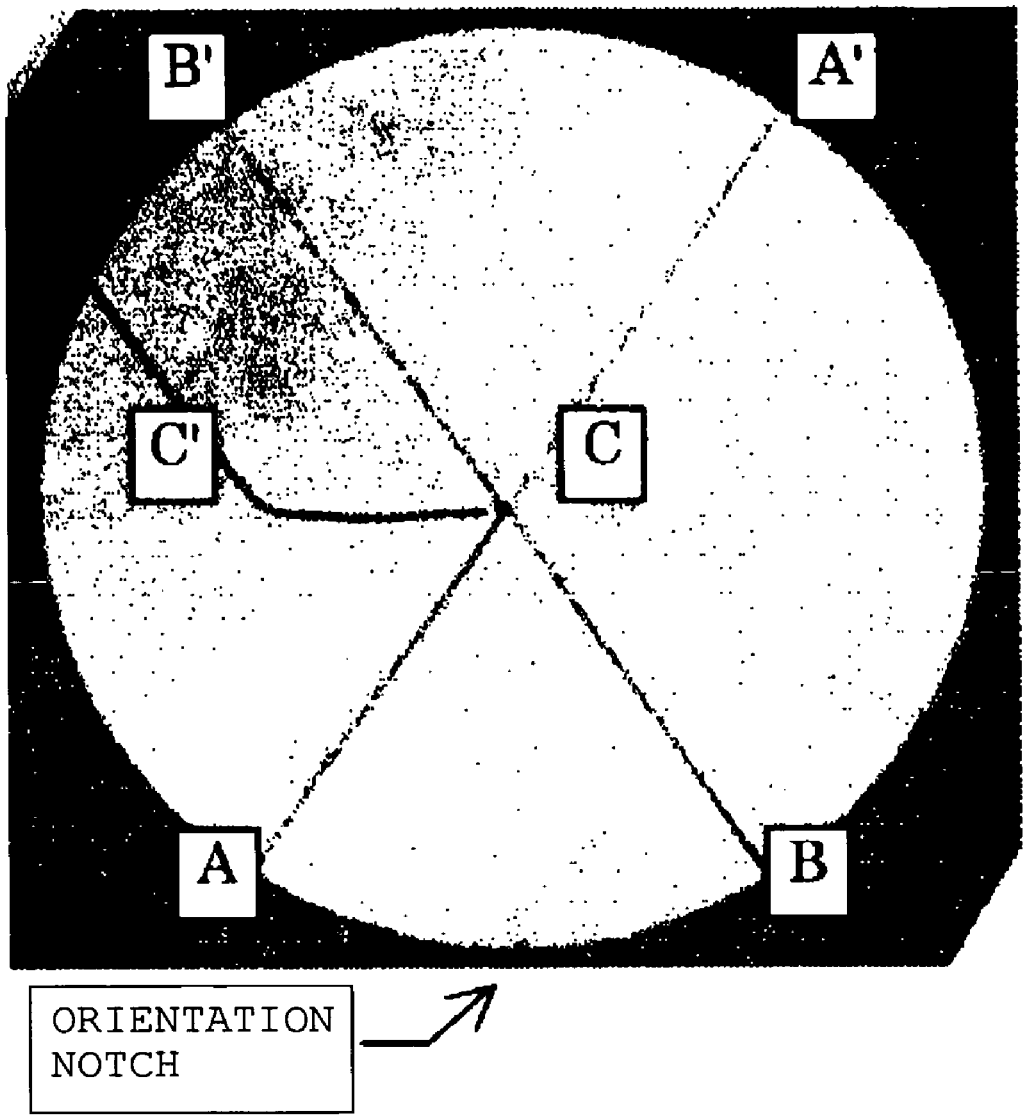
FIG. 3 is a view showing a state of breaking of a (110) silicon wafer.
Figure 4:
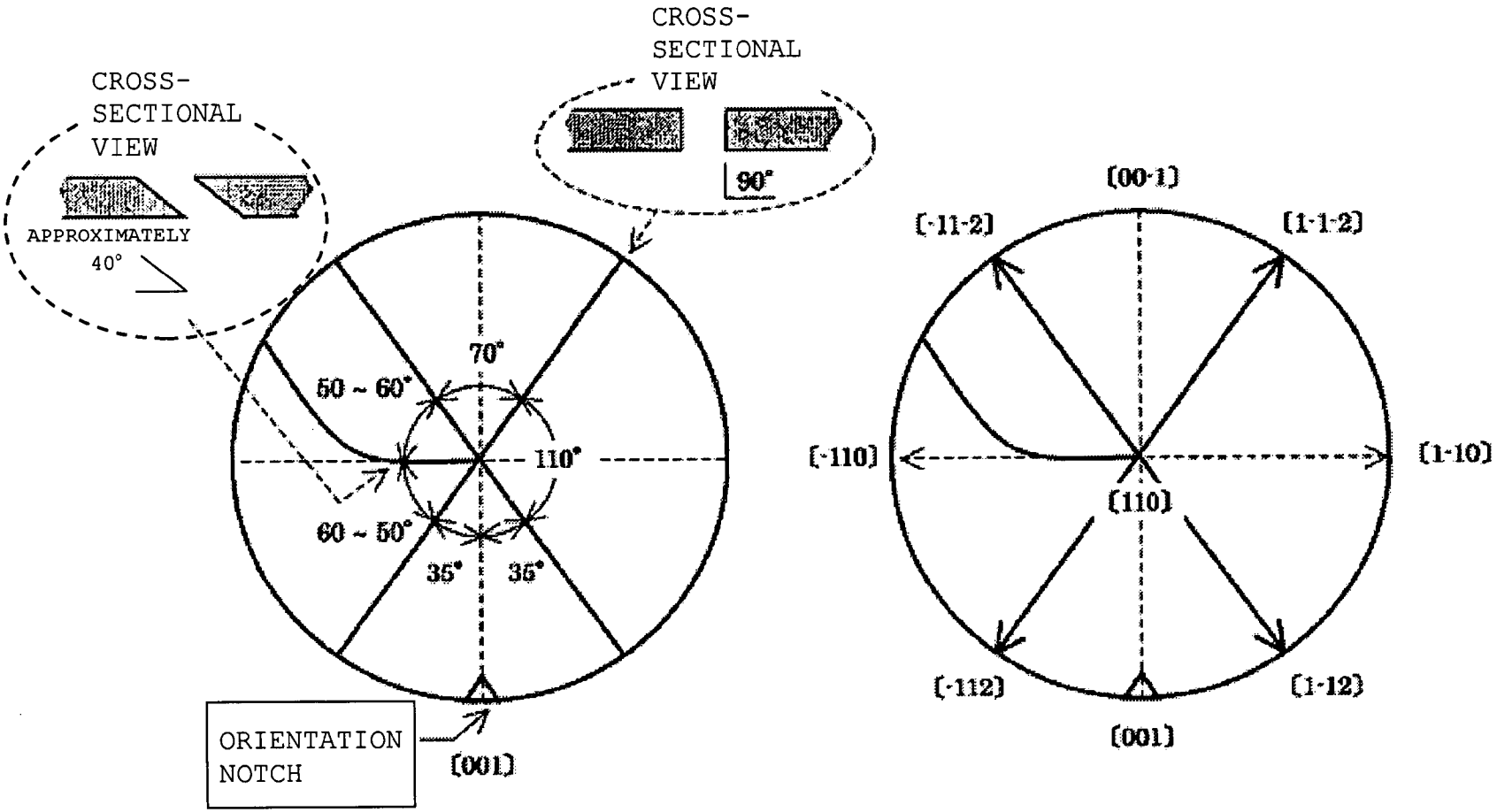
FIG. 4 is a view for explaining (a) angles of breaking and (b) crystal orientations of the (110) silicon wafer.

The present inventor has examined about a factor of breaking at the time of slicing which has been rarely specifically examined even though it leads to a serious problem in manufacture of the (110) silicon wafer that has recently come under the spotlight. FIG. 3 is a view showing a state of breaking of the (110) silicon wafer actually fabricated by the present inventors, and FIGS. 4(*a*) and (*b*) are views for explaining angles of breaking and crystal orientations.

Breaking is cleavage breaking along a specific crystal orientation, breaking mainly occurred in directions (A-A' and B-B') of approximately ±35° with respect to a [001] direction, and an angle of a cross section was approximately 90° with respect to a wafer front surface.

Further, breaking may secondarily occur in a direction (C-C') of approximately 90° with respect to the [001] direction in some cases, and an angle of a cross section was approximately 40° with respect to the wafer front surface. This breaking in the secondary direction has a low frequency of occurrence, and it changed to breaking in a direction of approximately 35° before reaching a wafer outer periphery.

Based on the above-explained results, since the cleaved surface of the silicon single crystal is a {111} plane, the following can be considered.

The direction of breaking of approximately ±35° with respect to the [001] direction corresponds to a [−112] direction and a [1-12] direction along which a (110) plane crosses a (1-11) plane and a (−111) plane at a right angle. Since each of the (1-11) plane and the (−111) plane as the cleaved surface crosses the (110) plane at a large angle of 90° in this manner, it can be considered that breaking readily occurs as compared with a (100) plane or a (111) plane whose cross angle with respect to the (1-11) plane or the (−111) plane is smaller than the above angle.

Further, the direction of breaking of approximately 90° that secondarily occurs with respect to the direction [001] corresponds to a [−110] direction or a [1-10] direction where the (110) plane crosses the (111) plane or a (11-1) plane at an angle of 35°.

As explained above, it was revealed that the (110) silicon wafer is apt to be broken in the direction of approximately ±35° with respect to the [001] direction, i.e., the [−112] direction and the [1-12] direction.

Thus, in view of the fact described in Japanese Patent Application Laid-open No. 9-262825 that a load applied to the cleaved surface becomes maximum and the wafer is apt to be broken when a cleavage direction becomes parallel to the traveling direction of the wire at the time of slicing, the present inventor has conceived that an angle at which the wire traveling direction is sufficiently apart from the cleavage direction of the silicon wafer can be formed by performing slicing in such a manner that each angle formed between the traveling direction of the wire in the wire saw and the [−112] direction and the [1-12] direction in the (110) silicon single crystal ingot exceeds 30° and breaking can be thereby avoided, thus bringing the present invention to completion.

It is to be noted that a lower limit of the angle exceeds 30° in the present invention because a wafer cleaving force given to the wafer by traveling of the wire in the wire saw can be sufficiently reduced to avoid breaking if the angle exceeds 30°. Furthermore, setting the lower limit of the angle to exceed 30° enables sufficiently increasing a range of selectable directions when actually selecting a traveling direction of the wire.

Although an embodiment according to the present invention will be explained hereinafter with reference to the drawings, the present invention is not restricted thereto.

Figure 2:
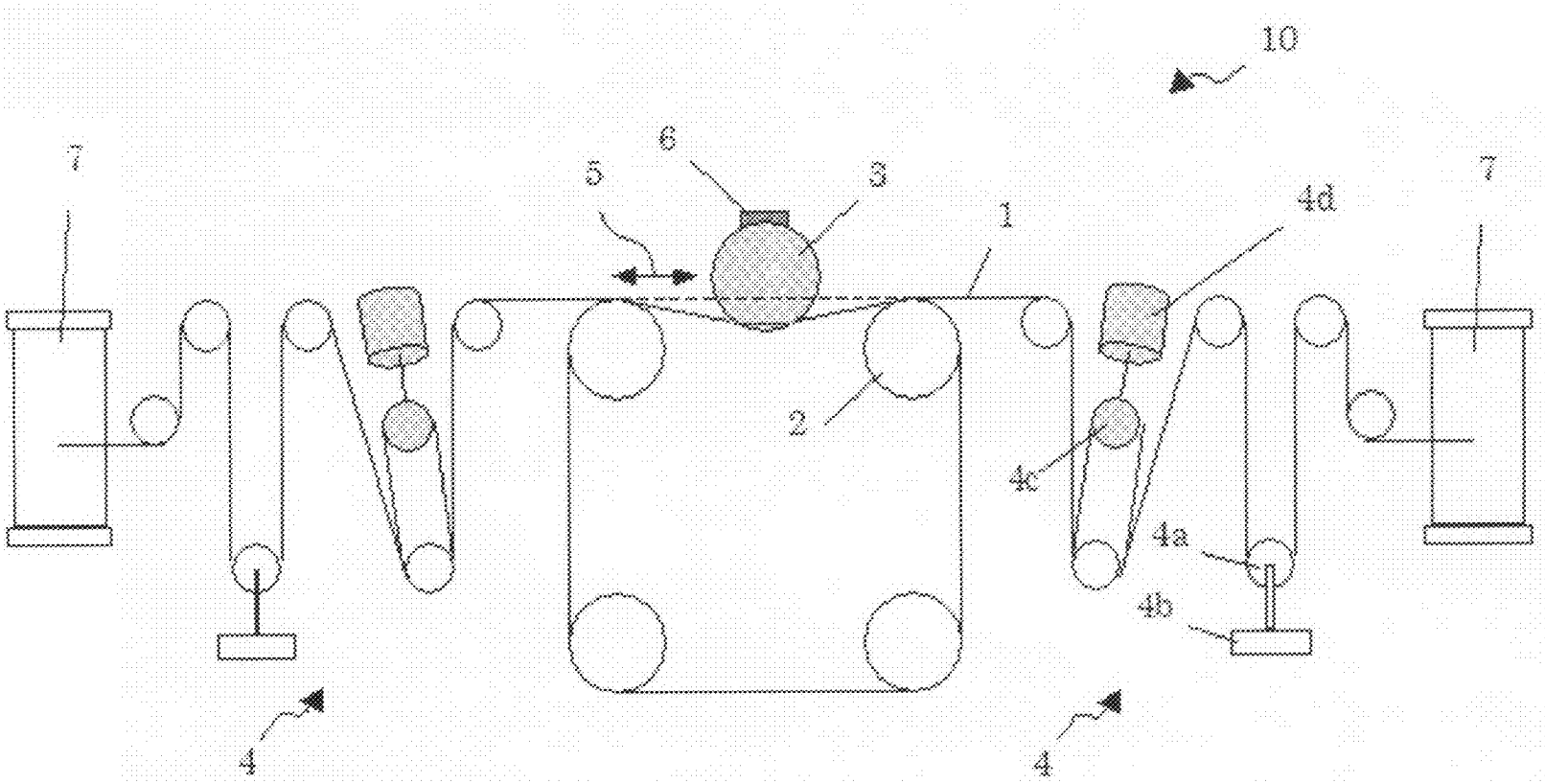
FIG. 2 is a schematic view showing an example of a conventional wire saw.

In a method for manufacturing a (110) silicon wafer according to the present invention, a silicon single crystal ingot having a plane orientation (110) is first disposed to a wire saw. This wire saw is not restricted to a specific type in particular, and such a conventional wire saw as shown in FIG. 2 can be used.

Although a slice beam is bonded to the silicon single crystal ingot and the silicon single crystal ingot is disposed to the wire saw through the slice beam, it is disposed to enable slicing in such a manner that each angle between a traveling direction of a wire in the wire saw and a [−112] direction and a [1-12] direction in the (110) silicon single crystal ingot or a direction crystallographically equivalent to these directions exceeds 30°.

Since disposing the ingot to enable slicing at the above-explained angle in this manner can suffice, an angle of the ingot may be adjusted to satisfy the angle after disposing if a tilt mechanism which can change an angle of the disposed ingot is provided in the wire saw, or the ingot may be disposed to satisfy the above-explained angle in advance if such a tilt mechanism is not provided.

A relationship between the traveling direction of the wire and the [−112] direction and the [1-12] direction in this example will now be specifically explained.

Figure 1:
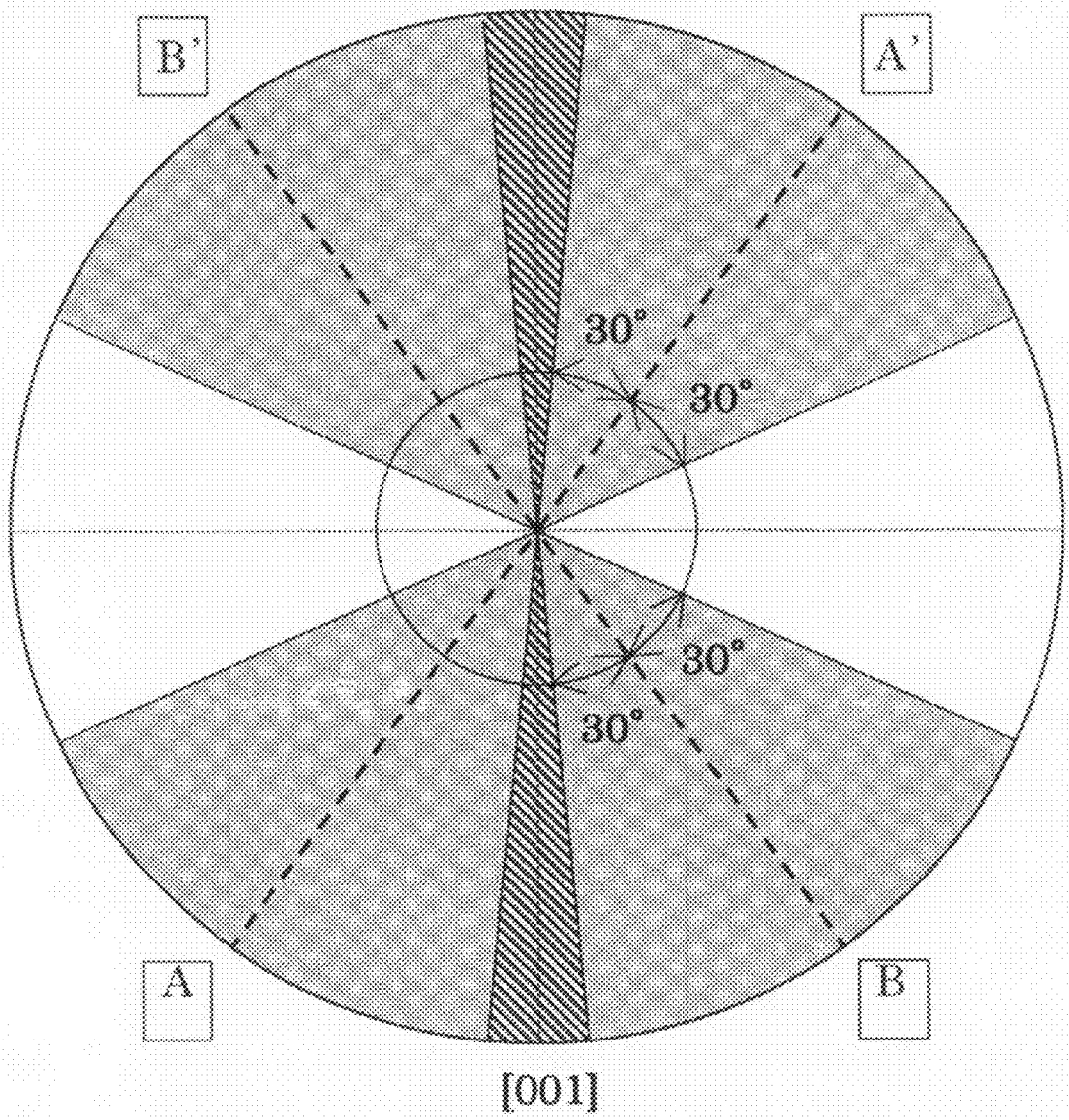
FIG. 1 is an explanatory drawing for explaining each angle formed between a traveling direction of a wire in a wire saw and a [−112] direction and a [1-12] direction in a (110) silicon single crystal ingot in a method according to the present invention.

FIG. 1 is an explanatory drawing for explaining each angle formed between the traveling direction of the wire in the wire saw, and the [−112] direction and the [1-12] direction in the (110) silicon single crystal ingot in the manufacturing method according to the present invention.

In FIG. 1, the traveling direction of the wire in the wire saw is set in such a manner that each angle formed between this direction and the [−112] direction (A-A') and the [1-12] direction (B-B') in the (110) silicon single crystal ingot exceeds 30°, i.e., it is set to avoid each colored range. Setting this direction in this manner enables forming an angle at which the traveling direction of the wire is sufficiently apart from a cleavage direction of the (110) silicon wafer, thereby avoiding breaking at the time of slicing (white ranges of outline, ranges of oblique lines).

In particular, the angle of 30° to 40° is formed from each of the [−112] direction and the [1-12] direction in the (110) silicon single crystal ingot. That is, it is preferable to set a direction of each shaded range in FIG. 1. For example, in case of a wafer having an orientation notch formed in the [001] direction as shown in FIG. 1, the wire traveling direction becomes within the range of ±5° from the [001] direction. Setting the wire traveling direction in this manner enables forming an angle at which not only the wire traveling direction is apart from both the [−112] direction and the [1-12] direction as main cleavage directions in the (110) silicon wafer but also the wire traveling direction is sufficiently apart from the [−110] direction or the [1-10] direction as a secondary cleavage direction, thus further avoiding breaking at the time of slicing.

Moreover, the (110) silicon single crystal ingot is disposed to the wire saw to enable slicing so as to satisfy the relationship of the angle, and then the (110) silicon single crystal ingot is sliced by using this wire saw. As a result, since the (110) silicon single crystal ingot can be sliced to satisfy the relationship of the angle, breaking of the wafer at the time of slicing can be avoided even if the wafer is the (110) silicon wafer which is apt to be broken as compared with the conventional (100) silicon wafer.

Although the present invention will now be specifically explained based on examples and comparative examples, the present invention is not restricted thereto.

EXAMPLES 1-3, COMPARATIVE EXAMPLES 1 AND 2

A silicon single crystal ingot with a plane orientation (110) and a diameter of 300 mm pulled up based on a Czochralski method was sliced by using a conventional wire saw having a tilt mechanism to fabricate each (110) silicon wafer. At this time, an angle formed between a traveling direction of a wire in the wire saw and a [−112] direction in the (110) silicon single crystal ingot was set to 30° and an angle formed between this traveling direction and a [1-12] direction of the same was set to 100° to perform slicing, thereby fabricating approximately 200 (110) silicon wafers (Example 1: white portion of outline in FIG. 1).

Moreover, slicing was performed in such a manner the wire traveling direction becomes the same as a [001] direction, i.e., angles of 35° are formed from both the [−112] direction and the [1-12] direction, thereby fabricating approximately 200 (110) silicon wafers (Example 2: shaded portion in FIG. 1).

Additionally, slicing was performed in such a manner that the wire traveling direction becomes the same as a [−110] direction, i.e., an angle formed between the wire traveling direction and the [−112] direction is 55° and an angle formed between the wire traveling direction and the [1-12] direction is 125°, thereby fabricating approximately 200 (110) silicon wafers (Example 3: white portion of outline in FIG. 1).

Further, like slicing of a regular (100) silicon wafer, slicing was carried out in such a manner that the wire traveling direction becomes the same as the [−112] direction to fabricate approximately 200 (110) silicon wafers (Comparative Example 1).

Furthermore, slicing was effected in such a manner that an angle formed between the wire traveling direction and the [−112] direction is 5° and an angle formed between the wire traveling direction and the [1-12] direction is 75°, thereby fabricating approximately 200 (110) silicon wafers (Comparative Example 2).

As a result, an occurrence rate of breaking of sliced wafers was approximately 30% of all the wafers in Comparative Example 1 and Comparative Example 2, but it is approximately 8% of all the wafers in Example 1 and Example 2, it was approximately 10% of all the wafers in Example 3, and the occurrence rate of breaking was greatly reduced.

It is to be noted that the present invention is not restricted to the foregoing examples. The foregoing examples are just exemplifications, and any inventions that have substantially the same structures as the technical concepts explained in claims of the present invention and demonstrate the same functions and effects are included in the technical scope of the present invention.

The invention claimed is:

1. A method of manufacturing a (110) silicon wafer by slicing a silicon single crystal ingot having a plane orientation (110) by a wire saw, wherein slicing is performed in such a manner that each angle formed between a traveling direction of a wire in the wire saw and a [−112] direction and a [1-12] direction in the (110) silicon single crystal ingot or a direction crystallographically equivalent to the directions exceeds 30°.

2. The method of manufacturing a (110) silicon wafer according to claim 1, wherein slicing is performed in such a manner that the angle becomes 30° to 40° from each of the [−112] direction and the [1-12] direction in the (110) silicon single crystal ingot or the direction crystallographically equivalent to the directions.

* * * * *